United States Patent [19]

Kataoka

[11] Patent Number: 4,682,929

[45] Date of Patent: Jul. 28, 1987

[54] DEVICE FOR TAKING OUT SHEET ROLLS AND MOUNTING SHEET ROLL CORES

[76] Inventor: Hiroshi Kataoka, 3686, Sangawacho, Iyomishima-shi, Ehime 799-04, Japan

[21] Appl. No.: 825,756

[22] Filed: Feb. 3, 1986

[51] Int. Cl.[4] ..... B65H 19/30

[52] U.S. Cl. ..... 414/589; 242/79; 242/81; 414/911

[58] Field of Search ..... 414/27, 589, 911; 242/79, 81

[56] References Cited

U.S. PATENT DOCUMENTS

| | | | |
|---|---|---|---|
| 478,731 | 7/1892 | Bancroft et al. | 414/911 X |
| 2,772,838 | 12/1956 | Lenz | 242/81 X |
| 3,131,880 | 5/1964 | Miller et al. | 242/81 X |
| 3,473,748 | 10/1969 | Merrill et al. | 242/81 X |
| 3,938,671 | 2/1976 | Lewey et al. | 414/911 X |
| 4,390,138 | 6/1983 | Rohde et al. | 242/81 X |
| 4,431,142 | 2/1984 | Kataoka | 414/669 X |
| 4,611,769 | 9/1986 | Orbach | 242/81 X |

*Primary Examiner*—Leslie J. Paperner

*Attorney, Agent, or Firm*—Oblon, Fisher, Spivak, McClelland & Maier

[57] ABSTRACT

A device for taking out sheet rolls and mounting sheet roll cores comprises a wheeled roll holder support capable of being advanced and retracted with respect to the sheet rolls, a sheet roll holder provided on the sheet roll holder support for vertical movement thereon and capable of receiving the sheet rolls, and core holding means provided on the sheet roll holder support or the sheet roll holder. This device is adapted to be used for a sheet winder which has a mechanism for discharging sheet rolls by withdrawal of a take-up shaft in the axial direction thereof from the sheet rolls. With this device, the withdrawn take-up shaft is returned to the take-up position after the sheet rolls have been discharged.

5 Claims, 19 Drawing Figures

DEVICE FOR TAKING OUT SHEET ROLLS AND MOUNTING SHEET ROLL CORES

FIELD OF THE INVENTION

This invention relates to a device for taking out sheet rolls and mounting sheet roll cores in a sheet winder.

BACKGROUND OF THE INVENTION

Conventionally, every time sheet rolls are formed in a sheet winder, they are hoisted together with their cores by a crane operated by the operator to be brought in this state to a take-up shaft withdrawal position, in which the take-up shaft is withdrawn from the sheet rolls. New cores for taking up sheets are subsequently mounted on the withdrawn take-up shaft, and in this state the take-up shaft is mounted again in the sheet winder.

Recently, large-diameter and heavy-weight sheet rolls are formed on sheet winder take-up shafts. Where such a large sheet roll is taken out of the sheet winder by hoisting it with a crane, it is liable to swing unstably.

In another aspect, in case of a sheet winder with a sheet slitter where slit sheets are taken up in upper and lower groups, the sheet rolls in the two groups cannot be taken out of the sheet winder at the same time.

Further, after the sheet rolls have been taken out, a plurality of new cores are mounted one after another on the take-up shaft, or two take-up shafts are set parallel for the take-up of new sheets. In either case, considerable time and labor are required, and during this operation the take-up operation is interrupted, reducing productivity.

OBJECT OF THE INVENTION

An object of the invention is to provide a device for taking out sheet rolls and mounting sheet roll cores for a sheet roll winder, which permits ready take-out of sheet rolls and ready mounting of new cores on take-up shafts, thereby extremely curtailing the stand-by period of the sheet winder during the take-out of sheet rolls and mounting of cores.

SUMMARY OF THE INVENTION

To attain the above object of the invention, there is provided a device for taking out sheet rolls and mounting sheet roll cores for a sheet winder with a mechanism for discharging sheet rolls by withdrawal of a take-up shaft in the axial direction thereof from the sheet rolls, the withdrawn take-up shaft being returned to the take-up position after the sheet rolls have been taken out, which comprises a wheeled sheet roll holder support capable of being advanced and retracted with respect to the sheet rolls, a sheet roll holder provided on the sheet roll holder support for vertical movement thereon and capable of receiving the take-up sheet rolls, and core holding means provided on the sheet roll holder support or the sheet roll holder.

When a predetermined length of sheet has been taken up to form sheet rolls on the take-up shaft in the sheet winder, the wheeled support is advanced to bring each sheet roll holder to a position directly underneath the sheet rolls. In this state, the sheet roll holder is raised up to a sheet roll support position, at which the sheet roll holder is in contact with the underside of the sheet rolls. When the sheet rolls have been supported on the sheet roll holder in this way, only the take-up shaft is moved transversely to withdraw it from the sheet rolls. The withdrawn take-up shaft is held in that position. The wheeled support is then retracted, and the sheet roll holder is raised to bring new cores, which are held by a core holder means provided on the sheet roll holder, to the position to which the take-up shaft has been withdrawn. Then, the take-up shaft is returned to the initial set position in the sheet winder. As the take-up sheet is returned, it penetrates the new cores. In consequence, the new cores are mounted in the sheet winder. Then, the cores are released from the core holder means with the operation thereof. Now, the take-up of sheets on the cores is started, while the wheeled support carrying the sheet rolls is moved away from the sheet winder to a position for removing the sheet rolls from the wheeled support by suitable means.

Thus, as soon as the sheet rolls are formed, the take-up shaft is withdrawn therefrom, and new cores are set in a predetermined position in the sheet winder before the released sheet rolls are taken out. The period during which the sheet winder is held in the standby state thus can be greatly reduced. In addition, the operation of mounting cores is performed very smoothly and accurately.

BRIEF DESCRIPTION OF THE DRAWING

The above and other objects and features of the invention will become more apparent from the following description of the invention when the same is read with reference to the accompanying drawings, in which.

DETAILED DESCRIPTION OF THE PREFERRED EMBODIMENTS

Figure 1:
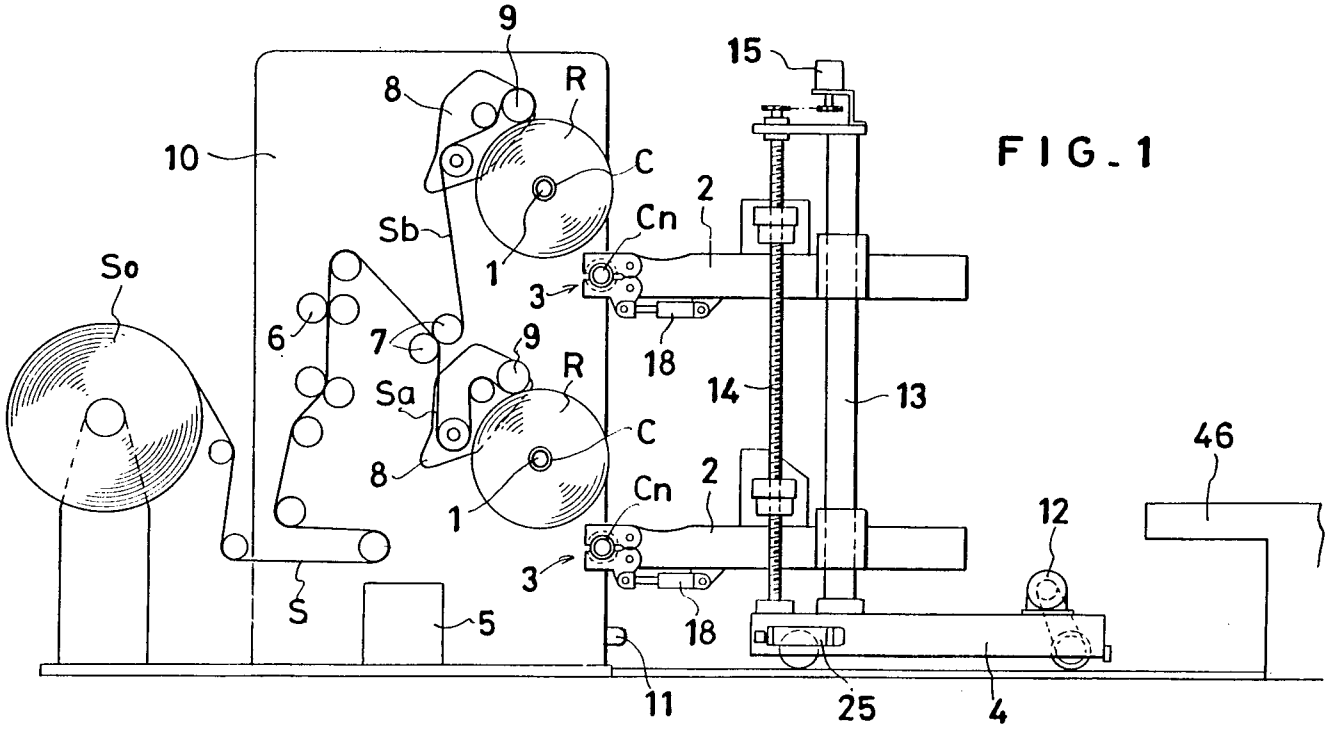
FIG. 1 is a side view showing an embodiment of the device for taking out sheet rolls and mounting sheet roll cores according to the invention.

FIGS. 1 to 4 show an embodiment of the device for taking out sheet rolls and mounting sheet roll cores according to the invention applied to a sheet winder with a slitter. The sheet winder will first be described with reference to FIG. 1. A sheet S paid out from material sheet roll So is led by a plurality of guide rollers provided in a frame 10 to a slitter 6 to be slit into a plurality of slit sheets having a predetermined width. In this embodiment, the slit sheets are separated by guide rollers 7 into upwardly traveling ones and downwardly traveling ones. Upper and lower portions of the frame 10 of the sheet winder are provided with touch rollers 9 supported by rockable arms 8. Slit sheets Sa and Sb are urged by the touch rollers 9 against cores C to be taken up while their tension is controlled to an optimum take-up tension. The touch rollers 9 are progressively raised with increasing diameter of the sheet rolls R.

When a predetermined length of sheet has been taken up, a controller 5 provided in the sheet winder is operated to stop the take-up. Then, a wheeled support 4 which has been held in a stand-by state apart from the sheet winder is advanced as guided by a guide mechanism, guide rails, etc. until it strikes a stopper 11 provided at a lower portion of the frame 10. In this embodiment, a power transmission mechanism between a drive motor 12 and the wheels of the wheeled support 4 is provided with a magnetic powder clutch. The motor 12 continues to operate even after the stopper 11 is struck by the wheeled support 4 so that the stopper 11 continues to be urged by the wheeled support 4.

Figure 5:
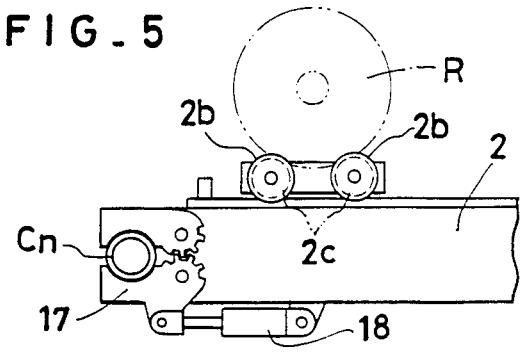
FIG. 5 is a view showing an essential part of a different example of a sheet roll receiving section in the device according to the invention.

The wheeled support 4 supports sheet roll holders 2 which have recesses 2*a* for receiving sheet rolls. The wheeled support 4 is brought to a position at which the recesses 2*a* are directly underneath the center of the sheet rolls R. As shown in FIG. 5, a sheet roll receiving section of the sheet roll holder 2 includes parallel receiving rollers 2*c* with wheels 2*b* provided at the opposite ends. The wheels 2*b* are supported on the sheet roll holder 2 and guided for movement therealong in the longitudinal direction of the sheet roll holder 2. The receiving rollers 2*c* are moved in parallel to the take-up shafts 1 of the sheet winder. The sheet rolls R are transferred from the take-up shafts 1 onto the parallel receiving rollers 2*c* at a sheet roll receiving position at the end of the sheet roll holder 2. The parallel sheet receiving rollers 2*c* are moved with the received sheet rolls R to the rear (proximal) end of the sheet roll holders 2 for transferring the sheet rolls from the wheeled support 4 onto a work table 46 for the next process. In this way, the sheet rolls can be readily taken out and transferred, and also soiling of the sheet roll surface can be prevented. The wheeled support 4 may be replaced with any movable support with or without wheels capable of carrying out the same function.

In the illustrated embodiment, the wheeled support 4 supports two, i.e., upper and lower, sheet roll holders 2. The sheet roll holders 2 are supported by a vertical guide post 13 and a vertical drive screw 14 at positions corresponding to the upper and lower take-up positions. The drive screw 14 is driven for rotation by a motor 15 provided at the upper end of the guide post 13 and the drive screw 14. The sheet roll holders 2 are coupled via respective clutches to the drive screw 14 and are simultaneously raised and lowered along the guide post 13 with the rotation of the drive screw 14.

Reference numeral 3 designates a core holder means. In this embodiment, each core holder means 3 includes a pair of, i.e., upper and lower, gutter-like clamp members 16 (FIG. 4) for vertically clamping new cores Cn. The clamp members 16 are provided at the opposite ends with upper and lower openable arms 17 having gear portions. The openable arms 17 are operable symmetrically with their gear portions in mesh with one another. The lower openable arm is driven by a hydraulic cylinder 18, which is controlled by the controller 5.

The wheeled support 4 is advanced until it is stopped by the stopper 11. In this state, the sheet roll holders 2 are raised. When the recesses 2*a* for receiving the sheet rolls R come to the position for receiving the sheet rolls R, the rotation of the drive screw 14 is stopped by a limit switch or a like sensor (not shown). Alternatively, the ascent of the sheet roll holders 2 may be stopped when the underside of the sheet rolls R is struck by the sheet roll holders 2 or when a slight upward pressure is applied to the sheet rolls R after the striking of the sheet roll underside by the sheet roll holders 2.

After the sheet rolls R have been stably supported in the recesses 2*a* of the upper and lower sheet roll holders 2, the take-up shafts 1 are withdrawn from the cores C of the sheet rolls R by a take-up shaft insertion/removal unit provided on one side surface of the frame 10.

Figure 6:
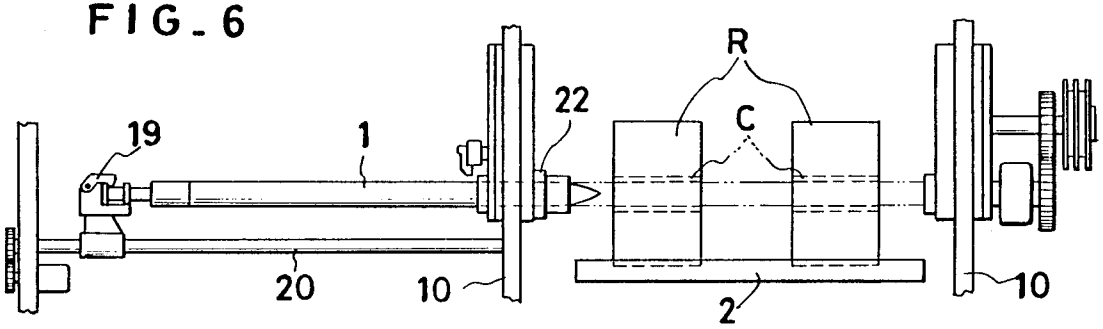
FIG. 6 is a view showing an example of a take-up shaft insertion/removal unit.

FIG. 6 shows an example of the take-up shaft insertion/removal unit provided in the sheet winder. The unit has a gripper 19 which can grip the non-driven end of the take-up shaft 1. In this state, the unit is moved along a rail 20, whereby the take-up shaft 1 is withdrawn from the sheet rolls R. When the take-up shaft 1 has been completely withdrawn from sheet rolls R, it is held in this state.

Figure 7:
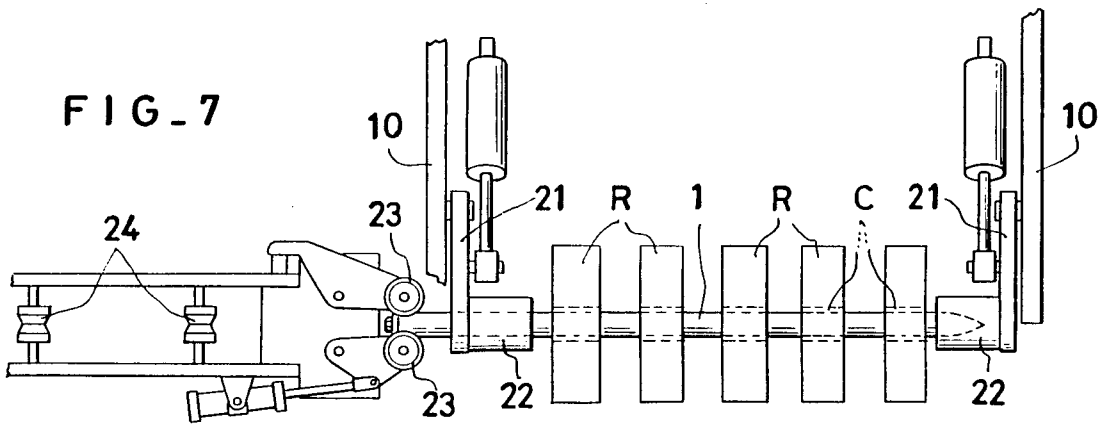
FIG. 7 is a view showing a different example of the take-up shaft insertion/removal unit.

The take-up shaft insertion/removal unit shown in FIG. 6 is by no means limitative. FIG. 7 shows a different example of the take-up shaft insertion/removal unit. In this unit, bearing 22 provided at the end of rockable arms 21 are held at a shaft withdrawal position, and a pair of clamp rollers 23 are driven to clamp one end of the take-up shaft 1 and are then rotated in the direction of withdrawal, whereby the take-up shaft 1 is withdrawn onto receiving rollers 24. The other end of the take-up shaft 1 has a conical shape, for instance, while a corresponding portion of the bearing 22 supported in the frame 10 has a complementary conical recess. The take-up shaft 1 is coupled to the bearing 22 through the engagement of the conical end in the conical recess.

When the take-up shaft 1 has been withdrawn by the take-up shaft insertion/removal unit described above, the remaining sheet rolls R are supported by a solitary sheet roll holder 2.

Subsequently, a hydraulic cylinder 25 (see FIG. 1) for positioning, which is provided on one side of the wheeled support 4, is operated to extend its rod so as to push the frame 10 of the sheet winder. In consequence, the wheeled support 4, which continuously pushes the stopper 11, is separated together with the sheet rolls R from the frame 10 by a predetermined distance, bringing the cores Cn held in the core holder means 3 to a position directly underneath the position at which each take-up shaft is withdrawn before the transport of the sheet rolls R to the right. Since the motor 12 for driving the wheeled support 4 is continuously driven, the wheeled support is retracted accurately to an extent corresponding to that by which the rod of the cylinder 25 is extended.

Figure 2:
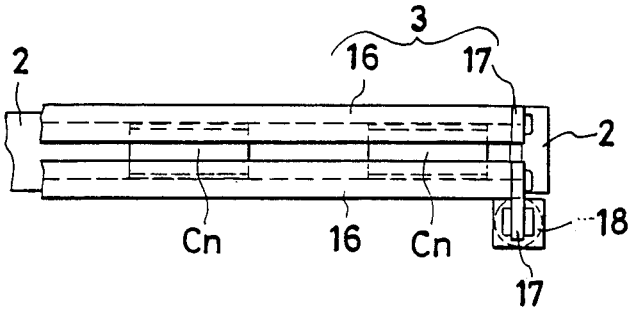
FIG. 2 is a front view showing an example of core holder means in the device shown in FIG. 1.
Figure 3:
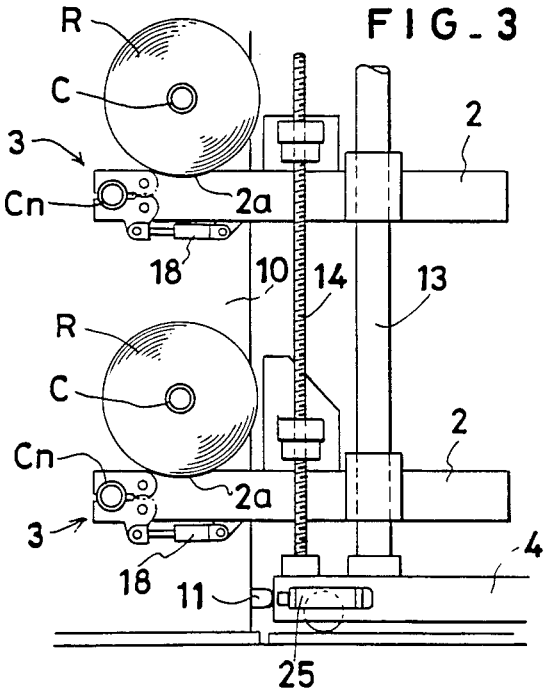
FIG. 3 is a view showing the device shown in FIG. 1 carrying sheet rolls formed in the sheet winder.
Figure 4:
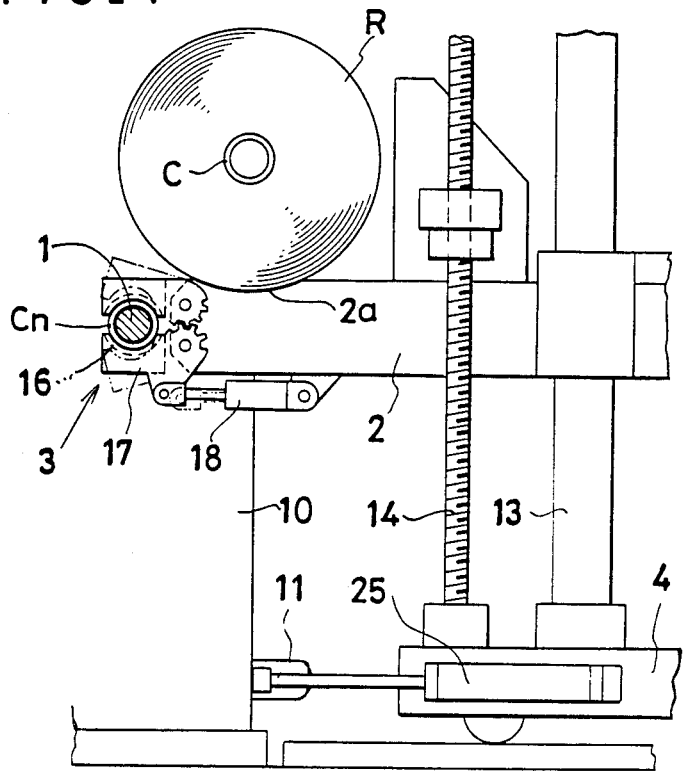
FIG. 4 is a view showing the device shown in FIG. 1 during insertion of a take-up shaft into new cores.
Figure 8:
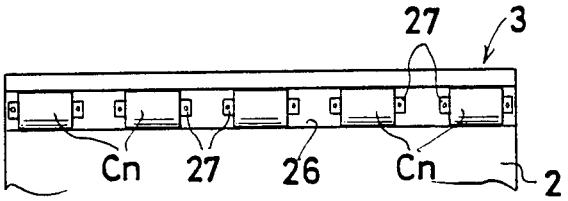
FIG. 8 is a plan view showing a further example of the take-up shaft insertion/removal unit.
Figure 9:
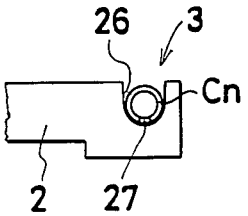
FIG. 9 is a side view showing the take-up shaft insertion/removal unit shown in FIG. 8.

Thereafter, the sheet roll holders 2 are raised by a predetermined distance to bring new cores Cn into the position at which each take-up shaft is withdrawn before the transfer of the sheet rolls R onto the sheet roll holders 2. When the new cores are brought to this position (i.e., the position which was occupied by each take-up shaft of the sheet winder), each take-up shaft 1 is returned to the set position in the sheet winder by reversely driving the gripper 19 or the rollers 23 of the take-up shaft insertion/removal unit. At this time, the cores Cn are held by the core holder means 3 against axial displacement due to friction with the take-up shafts 1. In the case of the core holder means 3 of the clamping type as shown in FIG. 2, the cores Cn are clamped with a clamping pressure such that they will not be deformed and that they will not be axially displaced at the time of the advance of the take-up shafts 1. The core holder means 3 of the clamping type is by no means limitative, and FIGS. 8 and 9 show a different example of the core holder means. In this example, the end of the sheet roll holder 2 is formed with a core receiving groove 26 having a U-shaped sectional profile conforming to the outer shape of the core. Cores are entirely received in the groove 26 and are retained by retainers 27, which prevent axial displacement of the cores but do not prevent the advance of the take-up shaft 1. Where a plurality of cores are fitted at predetermined intervals on the take-up shaft 1 using the core holder means of the clamping type shown in FIG. 2, the cores are held against axial displacement by providing retainers for each core or providing cylindrical spacers between the adjacent cores.

With the advance of the take-up shaft 1 to the set position in the sheet winder (i.e., with the coupling of the take-up shaft 1 to the drive shaft), new cores Cn are mounted on the take-up shaft 1 at predetermined positions thereof. Thereafter, with the core holder means shown in FIG. 2, the openable arms 17 are opened by operating the cylinders 18. With the core holder means 3 of the groove type shown in FIG. 8, the sheet roll holder 2 is lowered slightly away from the cores Cn and the the wheeled support 4 is retracted. The motor 12 of the wheeled support 4 is continuously driven forwardly from the start of the advance of the wheeled support 4 and also while the wheeled support 4 is stationary after its advance (for instance, with slipping of a magnetic powder clutch), thus providing torque to the wheels to aid the positioning of the sheet roll holders 2. It is driven reversely when and only when the wheeled support 4 is retracted.

With the core holder means as described above provided at the end of the sheet roll holder 2, the wheeled support drive mechanism and the sheet roll holder drive mechanism can be used for the positioning between the core holder means and the take-up shaft, so that the construction of the wheeled support 4 for the transport of the sheet rolls R can be simplified.

However, it is possible to provide sensors at the sheet roll receiving position and at a position corresponding to the core mounting position and to stop the wheels of the wheeled support 4 in response to the detection of these positions. As a further alternative, the displacements up to the sheet roll receiving position and the position corresponding to the core mounting position may be counted by counters, and the movement of the wheeled support 4 (i.e., the movement of the wheels thereof) may be stopped at the time that the counts of these counters have reached predetermined values.

Figure 10:
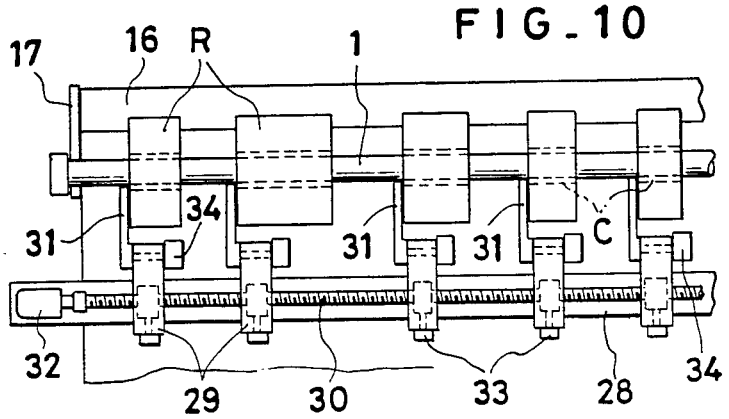
FIG. 10 is a plan view showing an example of means for preventing axial displacement of sheet rolls.
Figure 11:
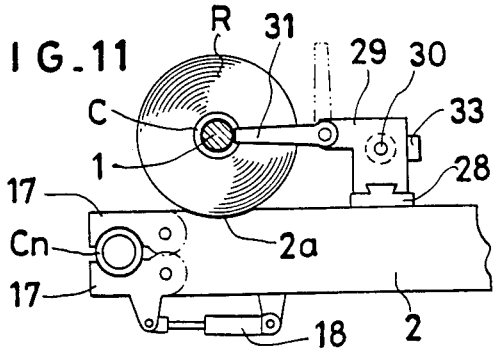
FIG. 11 is a side view showing the axial movement prevention means shown in FIG. 10.

When the take-up shaft 1 is withdrawn forcibly from the sheet rolls R on the wheeled support 2, axial displacement of sheet rolls R is liable to result. In such a case, the sheet roll surface will be damaged, or end deviation of the sheet roll is liable to result. FIGS. 10 and 11 show means for preventing the axial displacement of the sheet rolls R or the cores. In the illustrated arrangement, a rail 28 parallel to the take-up shaft 1 is provided on the sheet roll holder 2, and a plurality of arm holders 29 are slidably supported on the rail 28. The arm holders 29 are penetrated by a screw 30 which can be driven forwardly and reversely by a motor 32. Each arm holder 29 has a locking member 33 capable of being locked to the screw 30. Each arm holder 29 carries an arm 31 rotatably supported at its upper end. The arm 31 is driven by a motor 34 provided on the arm holder 29 for rotation between two positions, i.e., a horizontal operative position and a vertical retracted position. The arm 31 has a length such that it reaches core C when it is brought to the operative position.

With this arrangement, the arm holders 29 are brought to positions corresponding to the end faces of corresponding sheet rolls by turning the screw 30 and operating locking members 33 of the arm holders 29 with the arms 31 held at the retracted position. Then, the arms 31 are rotated to the operative position. As an alternative method of positioning the arm holders 29, it is possible to first rotate the arms 31 to the operative position and then move the arm holders 29 along the rail 28. When the arms 31 are thus positioned to be on the take-up shaft withdrawal side end of individual sheet rolls R, the take-up shaft 1 is withdrawn by operating the take-up shaft insertion/removal unit shown in FIG. 6 or 7. Thus, even if large forces of friction arise between the take-up shaft 1 and the cores at this time, the takeup shaft 1 can be withdrawn from the sheet rolls R while the axial displacement of the cores bearing the sheet rolls R is prevented by the arms 31. The means for preventing the axial displacement of the cores and sheet rolls may be provided on the side of the sheet winder as well.

Figure 12:
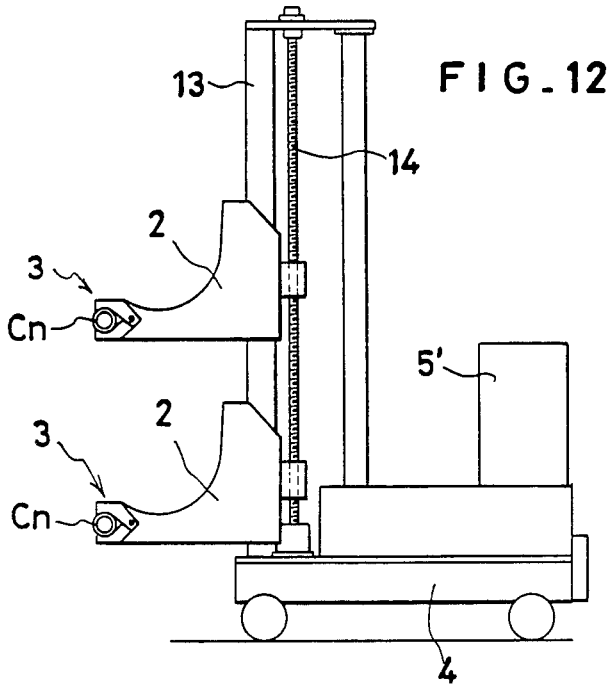
FIG. 12 is a schematic view showing a second embodiment of the device according to the invention.
Figure 13:
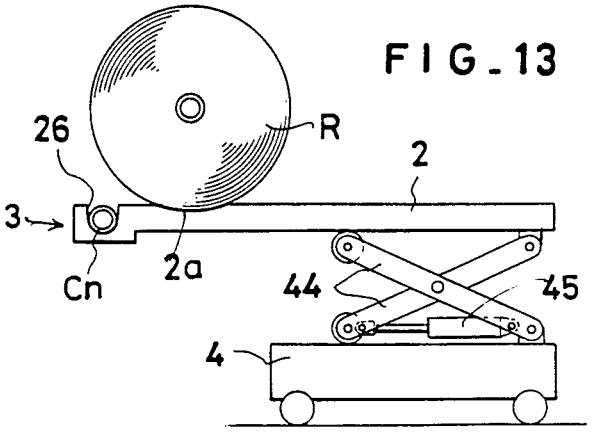
FIG. 13 is a schematic view showing a third embodiment of the device according to the invention.

FIGS. 12 and 13 show different examples of the wheeled support 4 with the sheet roll holders 2. The example of FIG. 12 has front and rear posts, and L-shaped sheet roll holders 2 are fitted on the front post 13. The sheet roll holders can be smoothly moved vertically along the post 13 with the rotation of the drive screw 14. In this example, a control unit 5' of the device for taking out sheet rolls and mounting sheet roll cores is provided on the wheeled support 4. The rear post is a reinforcement post.

The example of FIG. 13 supports only a single sheet roll holder 2, which is provided with the core holder means 3 shown in FIG. 8, i.e., the core receiving groove 26 and the retainers 27. The sheet roll holder 2 is driven by a simple drive mechanism consisting of a pantograph type link 44 and a hydraulic cylinder 45.

The invention may be utilized in a sheet winder of any type having a take-up shaft withdrawal mechanism. FIGS. 14 to 19 show examples of the sheet winder utilizing the invention.

Figure 14:
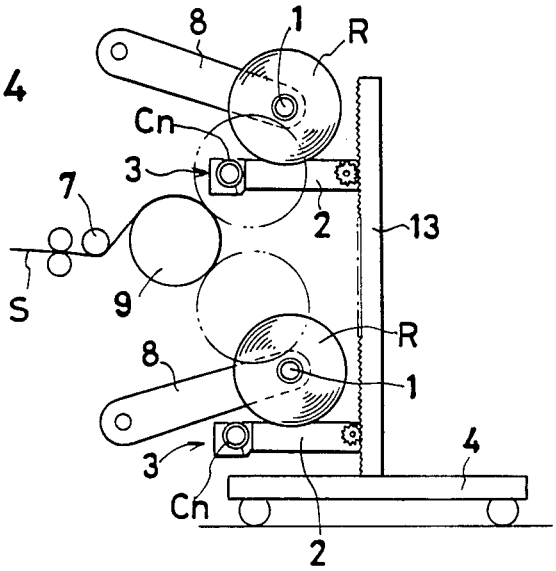
FIG. 14 is a schematic view showing a fourth embodiment of the device according to the invention.

In the example of FIG. 14, split sheets are separated into upper and lower groups as shown by phantom lines by touch roller 9 rotated at a fixed position, and split sheet rolls R are formed on the take-up shafts 1 at the end of the upper and lower arms 8, which are urged against the touch roller 9. Then the sheet rolls R are returned to the take-up shaft withdrawal positions shown by solid lines. The take-up shafts 1 are then withdrawn. The sheet rolls R are then transferred onto the sheet roll holders 2 on the wheeled support 4 at the advanced position. The drive mechanism for driving the sheet roll holders 2 is shown briefly in FIG. 14.

Figure 15:
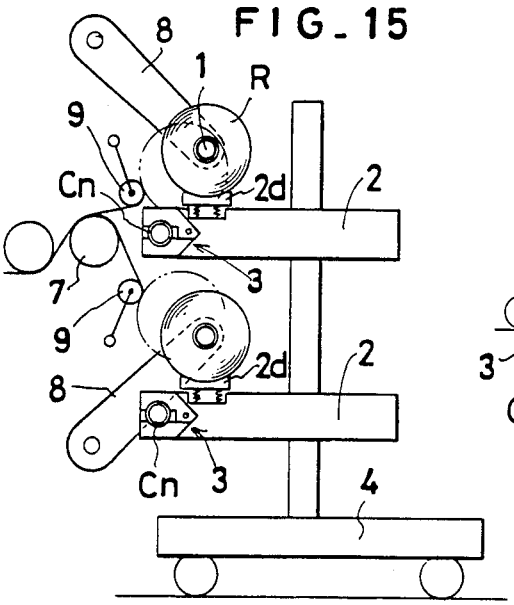
FIG. 15 is a schematic view showing a fifth embodiment of the device according to the invention.

In the example shown in FIG. 15, small rockable touch rollers 9 are provided at the upper and lower take-up positions. The sheet roll support position of the sheet roll holder 2 is provided not only with the recess 2*a* but also with a spring-biased receiving plate 2*d*. When a predetermined spring displacement extent is reached with the rise of the receiving plate 2*d* and contact thereof with sheet rolls R, a sensor switch (not shown) is operated to automatically stop the ascent.

Figure 16:
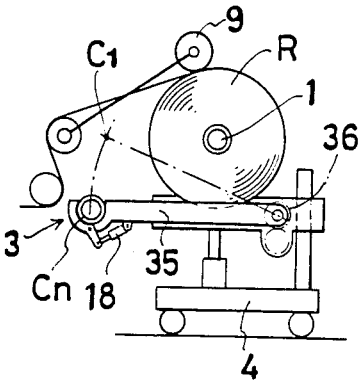
FIG. 16 is a schematic view showing a sixth embodiment of the device according to the invention.

In the example of the sheet winder shown in FIG. 16, the touch roller 9 is again rockable, while the take-up shaft 1 is rotated, inserted and withdrawn at a fixed position. The sheet roll holder 2 on the wheeled support 4 has vertically rockable arms 35 pivoted on stud shafts 36 on its opposite sides. The core holder means 3 of the clamping type are provided at the end of the arms 35 and opened and closed by the hydraulic cylinders 18. The cores Cn on the core holder means 3 can be brought to the take-up shaft withdrawal position by raising them up to a position $C_1$ corresponding to the height of the take-up shaft withdrawal position (which is the take-up position in this instance) and then causing the wheeled support 14 to retract by a given distance.

Figure 17:
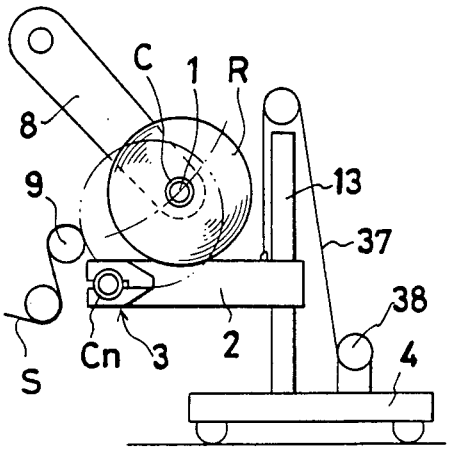
FIG. 17 is a schematic view showing a seventh embodiment of the device according to the invention.

In the example of the sheet winder shown in FIG. 17, the take-up shaft 1 carried by the arms 8 is urged against the touch roller 9 at a fixed position for taking up sheets. The mechanism for driving the sheet roll holder 2 on the wheeled support 4 consists of a wire rope 37 and a winch 38.

Figure 18:
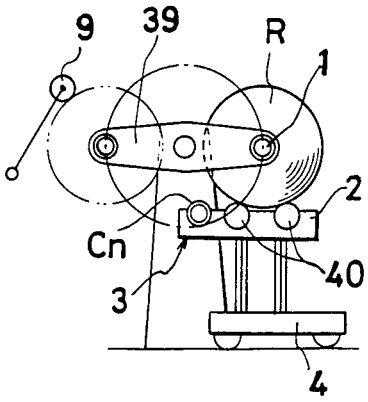
FIG. 18 is a schematic view showing an eighth embodiment of the device according to the invention.

In the example of the sheet winder shown in FIG. 18, the take-up shafts 1 are provided at opposite ends of turret type revolving arms 39. When the sheet rolls R are formed on the take-up shaft 1 on one side using the touch roller 9, they are revolved 180° to the opposite side to be taken out. The sheet roll holder 2 on the wheeled support 4 is raised and lowered hydraulically. At the sheet roll mounting position of the sheet roll holder 2, two parallel tubes 40 are provided.

Figure 19:
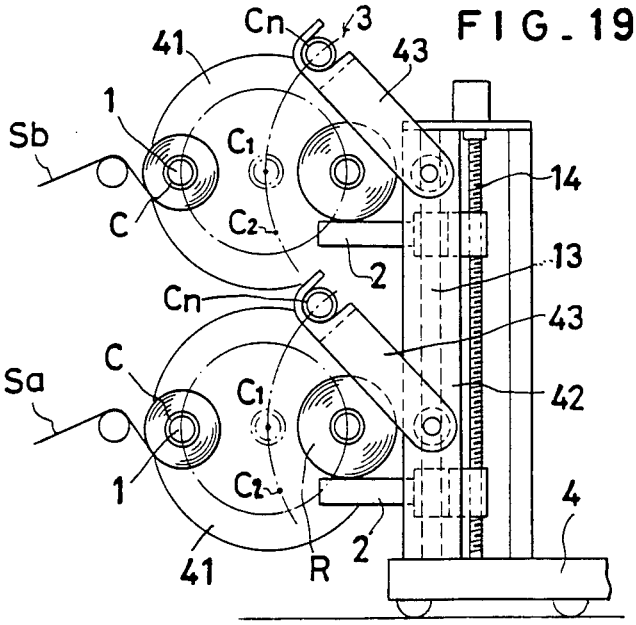
FIG. 19 is a schematic view showing a ninth embodiment of the device according to the invention.

The example of the sheet winder shown in FIG. 19 is also of the turret take-up shaft type. In this example, however, a disk-like revolving frame 41 is used in place of the revolving arms 39. The take-up shafts 1 are supported by upper and lower revolving frames 41 and used alternately for taking up groups of slit sheets. This example uses the device for inserting the take-up shaft 1 shown in FIG. 6. The core holder means 3, which are of the groove type, are not supported by the sheet roll holders 2 but are each supported by a pair of arms 43 pivoted on a frame 42 on the wheeled support 4. The pair of arms 43 are driven by a drive mechanism (not shown). The core holder means 3 can be brought to and held at the position $C_1$ at the same height as the take-up shaft withdrawal position before the sheet rolls R are transferred onto the sheet roll holder 2 in the direction of the sheet roll holder 2 toward the sheet winder and at the position at which it does not strike the sheet rolls R supported on the take-up shaft 1 when the sheet roll holder 2 is advanced toward the sheet winder. Thus, after the take-up shaft 1 is withdrawn and the sheet rolls R are transferred onto the sheet roll holder 2, the cores Cn can be brought to the take-up shaft withdrawal position by bringing the core holder means 3 to the position $C_1$ by driving the arms 43 and causing the wheeled support 4 to retract by a fixed distance. When the cores Cn have been mounted on the take-up shaft 1, the arms 43 are brought to the position $C_2$, and the cores Cn are detached from the core holder means 3.

It is to be understood that the above embodiments of the invention are by no means limitative but can be variously changed and modified by machine designers who are skilled in the art depending on the conditions under which the invention is carried out.

For example, in the sheet winders described above, either the take-up shaft is held at a fixed position for taking up sheets, or the take-up shaft is supported by rockable arms so that it is progressively displaced in a rocking fashion away from the touch roller with the build-up of the rolls of sheets being taken up. However, it is possible to support the take-up shaft such that it is slidable straight along a support away from a touch roller. Further, the sheet roll holder may be supported on the wheeled support or the like so that it is guided for advance and retraction with respect to the latter, that is, so that it can be retracted with the wheeled support or the like held stationary when mounting cores. Further, the wheeled support may be manually pushed to advance and retract it. Further, the sheet roll holder may be adapted to be manually driven for ascent and descent with an operating handle provided in the drive mechanism. Further, if the sheet roll holder is made turnable horizontally on the wheeled support, when the wheeled support with sheet rolls supported on the sheet roll holders is retracted to the neighborhood of the work table for the succeeding process, the sheet rolls can be transferred onto the work table by turning the sheet roll holder to direct its end to the work table and adjusting the height of the sheet roll holder to the height of the top of the work table. The control unit may be designed freely to be one for controlling one or more of the individual operations or one for automating the entire operation.

As has been described in the foregoing, according to the invention a sheet roll holder capable of being driven for ascent and descent is provided on a wheeled support or the like driven for advance and retraction, and when sheet rolls are formed in a sheet winder having a take-up shaft insertion/removal unit, the take-up shaft is withdrawn from the sheet rolls with the sheet rolls supported on the sheet roll holder. Thus, the take-up shaft can be readily withdrawn, and the sheet rolls can be taken out without being subject to impacts. Further, the sheet roll holder is provided with core holder means to hold new cores at the take-up shaft withdrawal position against axial displacement. Therefore, the operation of mounting the cores can be completed by a mere operation of returning the take-up shaft to the operative set position. When the sheet roll holder is brought to a position directly underneath the sheet rolls, there may be formed a gap between the two, so long as the gap is not so large as to have an adverse effect on the sheet rolls. Even if there is a slight gap between the sheet rolls and the sheet roll holder and the take-up shaft becomes just a cantilever, there is still no problem since the sheet rolls can be supported in contact with the sheet roll holder due to flexing of the take-up shaft. Of course, no excessive stress is applied to the take-up shaft.

Particularly, when sheet rolls are formed simultaneously on two take-up shafts or when slit sheets are taken up on a plurality of cores on a single take-up shaft, it is possible to transfer all the sheet rolls onto the sheet roll holder at one time and also to mount all the cores at one time. Thus, according to the invention the productivity can be greatly improved. Further, with a sheet winder for taking up sheets to form sheet rolls having a large diameter, the take-up position is at high level, so that the operation of taking out the sheet rolls has inferior operability and is highly hazardous. In such a case, it has been necessary to assure that the take-up position is suited for taking out sheet rolls by mounting the sheet winder on a countersink floor, for instance. According to this invention, the problems of restriction on the height of the take-up shaft can be alleviated. Further, it is possible to mount cores in core holder means for the next take-up at a position spaced apart from the sheet winder. The operation thus can be performed safely and without interrupting the take-up operation.

What is claimed is:

1. A sheet winder with a slitter, in which sheet winder a strip-like sheet is slit by a slitter into a plurality of slit sheets to be supplied to respective take-up shafts disposed at take-up positions and taken up on cores supported on said take-up shafts, said sheet winder comprising:

(a) take-up shaft withdraw and restoring means for effecting withdraw of each take-up shaft from its take-up position in the axial direction of the shaft and for restoring the shaft to its take-up position;

(b) a movable sheet roll support movable in a direction normal to the axis of each take-up shaft at the take-up position so as to be moved to a sheet roll acceptance position, a take-up shaft supply position, and a waiting position;

(c) a vertical guide post provided on said movable sheet roll support;

(d) at least one sheet roll holder capable of being raised and lowered along said vertical guide post and having an end portion extending toward a sheet take-up position;

(e) a sheet roll support base disposed for movement back and forth along said at least one sheet roll holder;

(f) core holding means provided on an end portion of said at least one sheet roll holder for holding a core parallel to the take-up shaft;

(g) means for positioning and driving said movable sheet support; and (h) means for raising and lowering said at least one sheet roll holder.

2. The sheet winder according to claim 1 wherein said core holding means includes:

(a) a pair of openable arms and (b) a pair of clamp members individually mounted on a respective one of said pair of openable arms for clamping the outer periphery of and holding the cores.

3. The sheet winder according to claim 1 wherein:

(a) upper and lower sheet roll holders are provided on said movable sheet roll support and (b) said upper and lower sheet roll holders are raised and lowered in unison with each other with the rotation of a common support screw.

4. The sheet winder according to claim 1 wherein said sheet roll support base is provided with parallel receiving rollers.

5. The sheet winder according to claim 1 wherein said movable sheet roll support is wheeled.

* * * * *